US007950949B2

(12) United States Patent
Saitoh

(10) Patent No.: US 7,950,949 B2
(45) Date of Patent: May 31, 2011

(54) CONNECTOR AND ELECTRONIC DEVICE SYSTEM

(75) Inventor: Takashi Saitoh, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 5 days.

(21) Appl. No.: 12/394,915

(22) Filed: Feb. 27, 2009

(65) Prior Publication Data

US 2009/0318005 A1 Dec. 24, 2009

(30) Foreign Application Priority Data

Jun. 23, 2008 (JP) ..... 2008-162742

(51) Int. Cl.
*H01R 13/62* (2006.01)

(52) U.S. Cl. ..... 439/372; 439/352

(58) Field of Classification Search ..... 439/352, 439/372, 304, 595
See application file for complete search history.

(56) References Cited

U.S. PATENT DOCUMENTS

| | | | | |
|---|---|---|---|---|
| 6,053,756 | A | 4/2000 | Flanigan et al. | |
| 7,396,250 | B1 * | 7/2008 | Huang | 439/352 |
| 2006/0194468 | A1 * | 8/2006 | Griffin | 439/352 |
| 2008/0318469 | A1 * | 12/2008 | Paglia et al. | 439/578 |

FOREIGN PATENT DOCUMENTS

| | | | |
|---|---|---|---|
| JP | 2002-514000 | A | 5/2002 |
| JP | 2004-165023 | A | 6/2004 |

* cited by examiner

*Primary Examiner* — Briggitte R Hammond
(74) *Attorney, Agent, or Firm* — Fujitsu Patent Center

(57) ABSTRACT

A connector includes a contact; a housing holding the contact; a cable inserted into the housing; a lock mechanism held in the housing and lockable with an opponent connector; and an operating portion having a tube shape covering the cable, operably connected to the housing, and releasing the lock in response to an operation.

14 Claims, 15 Drawing Sheets

CONNECTOR AND ELECTRONIC DEVICE SYSTEM

CROSS-REFERENCE TO RELATED APPLICATION

This application is based upon and claims the benefit of priority of the prior Japanese Patent Application No. 2008-162742, filed on Jun. 23, 2008, the entire contents of which are incorporated herein by reference.

FIELD

The embodiments discussed herein are related to a connector which has a lock mechanism and an electronic device system.

BACKGROUND

There has been known techniques relating to a connector which ensuring an electronic connection between electronic devices. Such a connector is provided with a lock mechanism which locks connection with a connector of an opponent device (hereinafter, referred to as opponent connector). When the connector connected with the opponent connector is removed, an operator releases the lock mechanism.

In such an opponent device, the opponent connectors are compactly aligned in a narrow area. However, when the connector connected with such an opponent device is removed, the lock mechanism is released. This release work may cause an interference with another connector connected adjacently. This may lower the workability in the removal of the connector.

SUMMARY

A connector disclosed herein includes: a contact; a housing holding the contact; a cable inserted into the housing; a lock mechanism held in the housing and lockable with an opponent connector; and an operating portion having a tube shape covering the cable, operably connected to the housing, and releasing the lock in response to an operation.

An electronic device system disclosed herein includes: a first connector provided in a main electronic system, the first connector comprising: a first contact; a first lock mechanism; and a second connector connectable with the first connector, the second connector comprising: a second contact connectable with the first contact; a housing holding the second contact; a cable inserted into the housing; a second lock mechanism held in the housing and lockable with the second lock mechanism; and an operating portion having a tube shape covering the cable, operably connected to the housing, and releasing the lock in response to an operation.

The object and advantages of the embodiments will be realized and attained by means of the elements and combinations particularly pointed out in the claims.

It is to be understood that both the foregoing general description and the following detailed description are exemplary and explanatory and are not restrictive of the embodiments, as claimed.

DESCRIPTION OF EMBODIMENTS

A description will be given of embodiments with reference to the accompanying drawings.

First Embodiment

Figure 1:
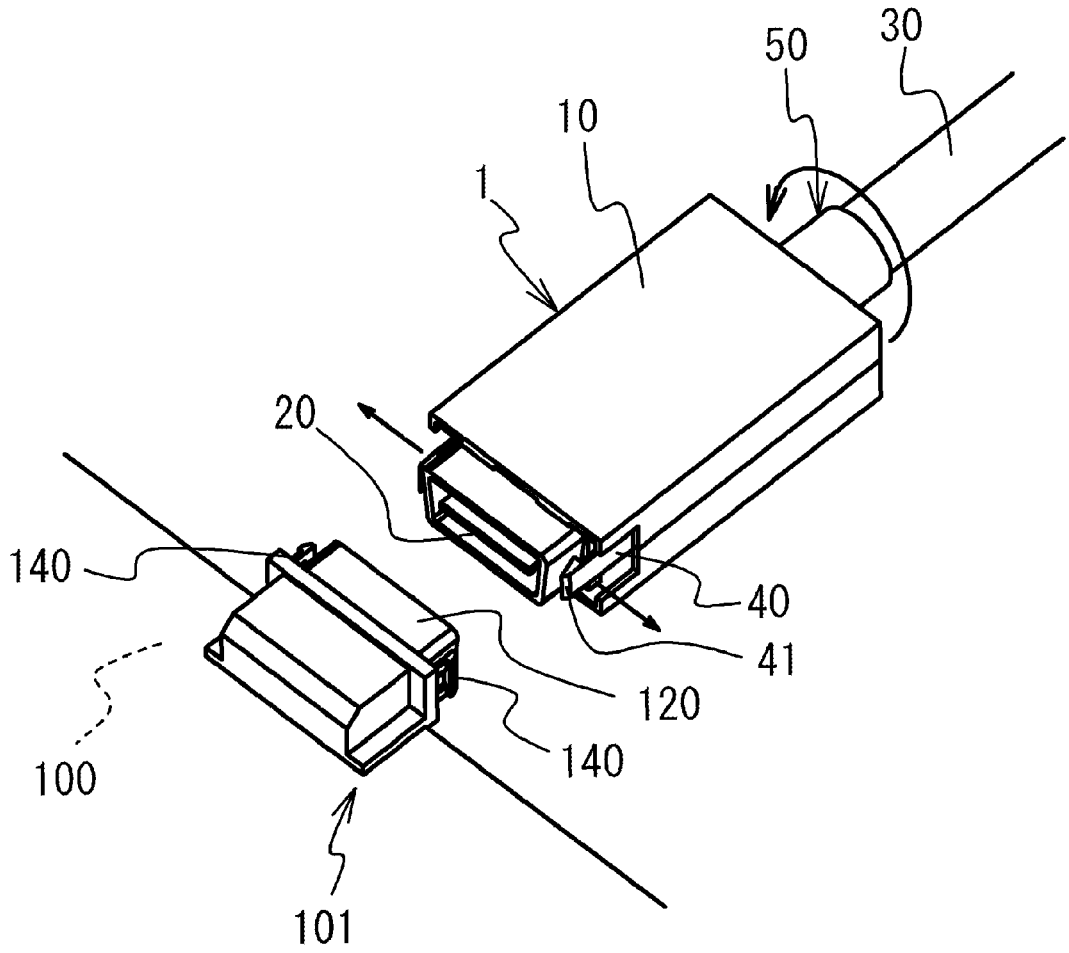
FIG. 1 is a view of a connector and an opponent connector provided in an opponent device connectable with the connector according to a first embodiment.

FIG. 1 is a view of a connector (second connector) 1 and an opponent connector (first connector) 101 provided in an opponent device (electronic device) 100 connectable with the connector 1 according to a first embodiment. The connector 1 and the opponent connector 101 provided with the body of main opponent device 100 are an electronic device system. The connector 1 is a so-called balanced transmission connector. For example, the connector 1 is an interface connector, having a lock mechanism for infiniband, Fast Ethernet (registered trademark), or SCSI (Small Computer System Interface).

As illustrated in FIG. 1, the connector 1 includes a housing 10, a male contact (second contact) 20, a cable 30, two engagement pieces (lock mechanism, second lock mechanism) 40, and an operating portion 50. The opponent connector 101 includes a female contact (first contact) 120 and an opponent engagement piece (first lock mechanism) 140. The contact 20 is held by the housing 10. The cable 30 is inserted into the housing 10. The engagement piece 40 is provided for locking the connector 1 with the opponent connector 101. The engagement piece 40, described in detail below, is made of a metallic and is formed into a thin plate shape to have elasticity. The operating portion 50 has a cylindrical shape to cover an outer circumference of the cable 30. The operating portion 50 is connected with the housing 10 for a rotational operation about the axis of the cable 30. The operating portion 50 releases the lock by means of the engagement piece 40 in response to the rotational operation. The operating portion 50 is made of a synthetic resin or the like.

Figure 2A:
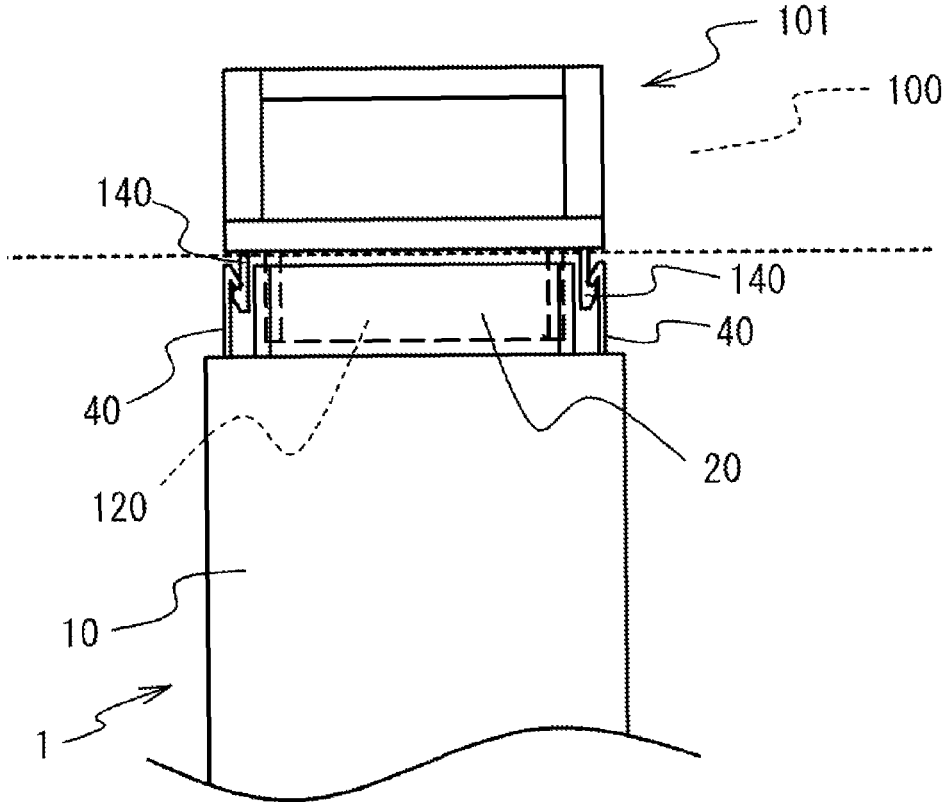
FIGS. 2A and 2B are explanatory views of a connected state of the connector with the opponent connector.
Figure 2B:
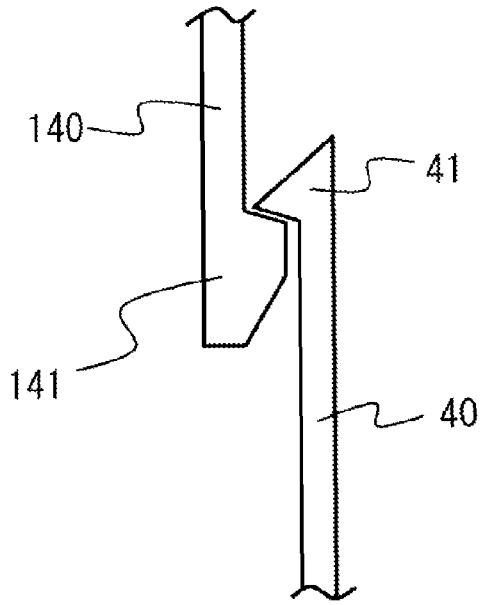

FIGS. 2A and 2B are explanatory views of a connected state of the connector 1 with the opponent connector 101.

FIG. 2A is a front view of the connected state of the connector 1 and the opponent connector 101. FIG. 2B is an enlarged view of the engagement piece 40 and the opponent engagement piece 140. In the connected state, the contacts 20 and 120 are fitted each other, and then, the engagement piece 40 and the opponent engagement piece 140 are engaged with each other. This locks the connection of the connector 1 with the opponent connector 101. In particular, a hook portion 41 provided at an end of the engagement piece 40 and a hook portion 141 provided at an end of the opponent engagement piece 140 are engaged with each other to be locked, as illustrated in FIG. 2B. Further, the lock by means of the engagement piece 40 is released by rotationally operating the operating portion 50. A detail description will be given below.

Figure 3:
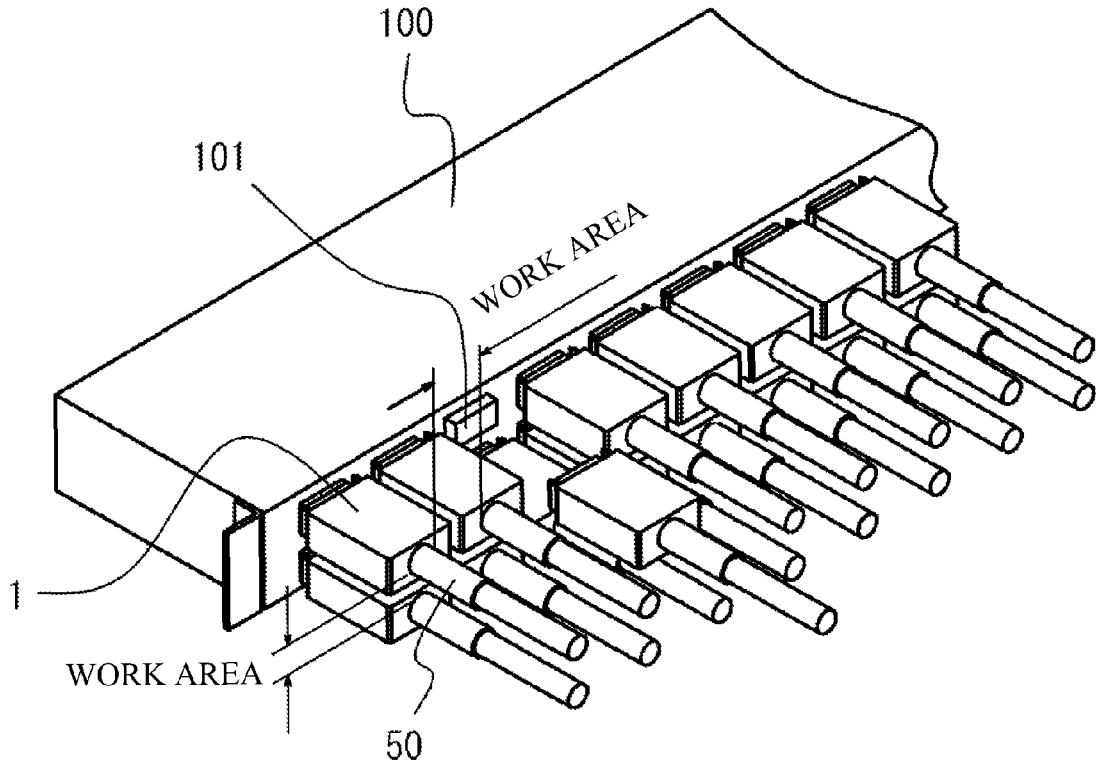
FIG. 3 is a view of a state in which the plural connectors are connected with the plural opponent connectors provided in a predetermined area of the opponent device.

FIG. 3 is a view of a state in which the plural connectors 1 are connected with the plural opponent connectors 101 provided in a predetermined area of the opponent device 100. The opponent device 100 is, for example, an infiniband switch, a First Ethernet HUB, or a storage device. The plurality of the opponent connectors 101 are compactly provided in the narrow area of the opponent device 100. The above mentioned, even when the connectors 1 are connected in the narrow area, the operating portion 50 needs to be rotationally operated in order to release the connection of the connector 1 with the opponent connector 101. Since the operating portion 50 has a cylindrical shape to cover the cable 30, the operating portion 50 is downsized. This prevents the interference of the operating portion 50 with another connector 1 adjacently connected.

Figure 4:
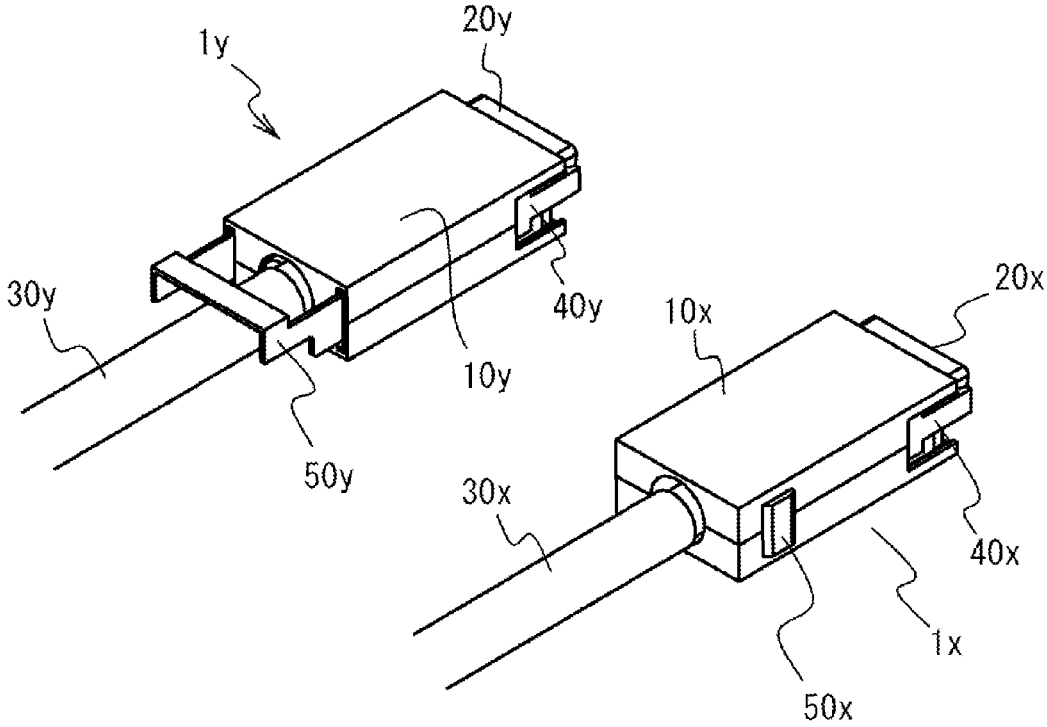
FIG. 4 is an explanatory view of connectors having a structure different from the connector.

Herein, a description will be given of connectors 1*x* and 1*y* having a differential structure from the connector 1. FIG. 4 is an explanatory view of the connectors 1*x* and 1*y* having a structure different from the connector 1. The 1*x* is provided with an operating portion 50*x* at a side wall side of the housing 10*x*. The operating portion 50 is exposed from a hole provided in the side wall. The lock is released by pushing the operating portion 50*x* while the 1*x* is being connected with the opponent device 100.

On the other hand, the connector 1*y* is provided with an operating portion 50*y* extending to the cable 30*y* from the housing 10*y*. The lock is released by pulling the operating portion 50*y* while the connector 1*y* is being connected with the opponent device 100.

Figure 5:
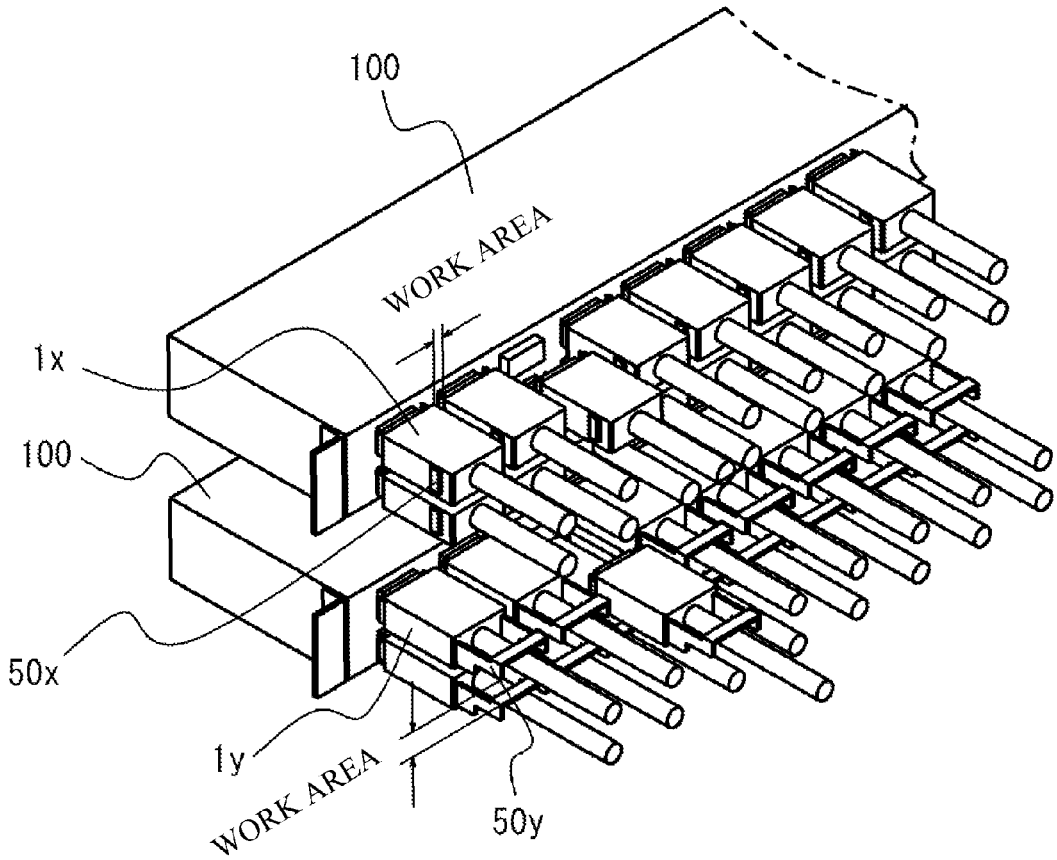
FIG. 5 is a view of a state in which the plural connectors illustrated in FIG. 4 are connected with the opponent device.

FIG. 5 is a view of a state in which the plural connectors 1*x* and 1*y* are connected with the opponent device 100. Each of the operating portions 50*x* and 50*y* has to be operated in order to release the lock. However, since the operating portion 50*x* is provided at the side wall side of the housing 10*x*, a finger has to be inserted between the adjacent housings 10*x* in order to release the lock. The above state, the work area for the release is narrow. The connector 1*y* is same as with the connector 1*x*. Accordingly, the workability in the removal is poor in the connectors 1*x* and 1*y*.

However, the connector 1 according to the present embodiment has the operating portion 50 formed into a cylindrical shape to cover the cable 30, as illustrated in FIG. 3. In addition, the diameter of the operating portion 50 is smaller than the height and the width of the housing 10. In this manner, the operating portion 50 is downsized as compared to one illustrated in FIG. 4. Therefore, a distance between the operating portions 50 is greater than a distance between the housings 10 of the adjacent connectors 1. In this manner, work area for operating the operating portion 50, namely, for releasing the lock is arranged to be wider. This allows a user to operate the operating portion 50 with ease, so that the lock can be released. Therefore, the workability in the removal of the connector 1 is improved.

Figure 6:
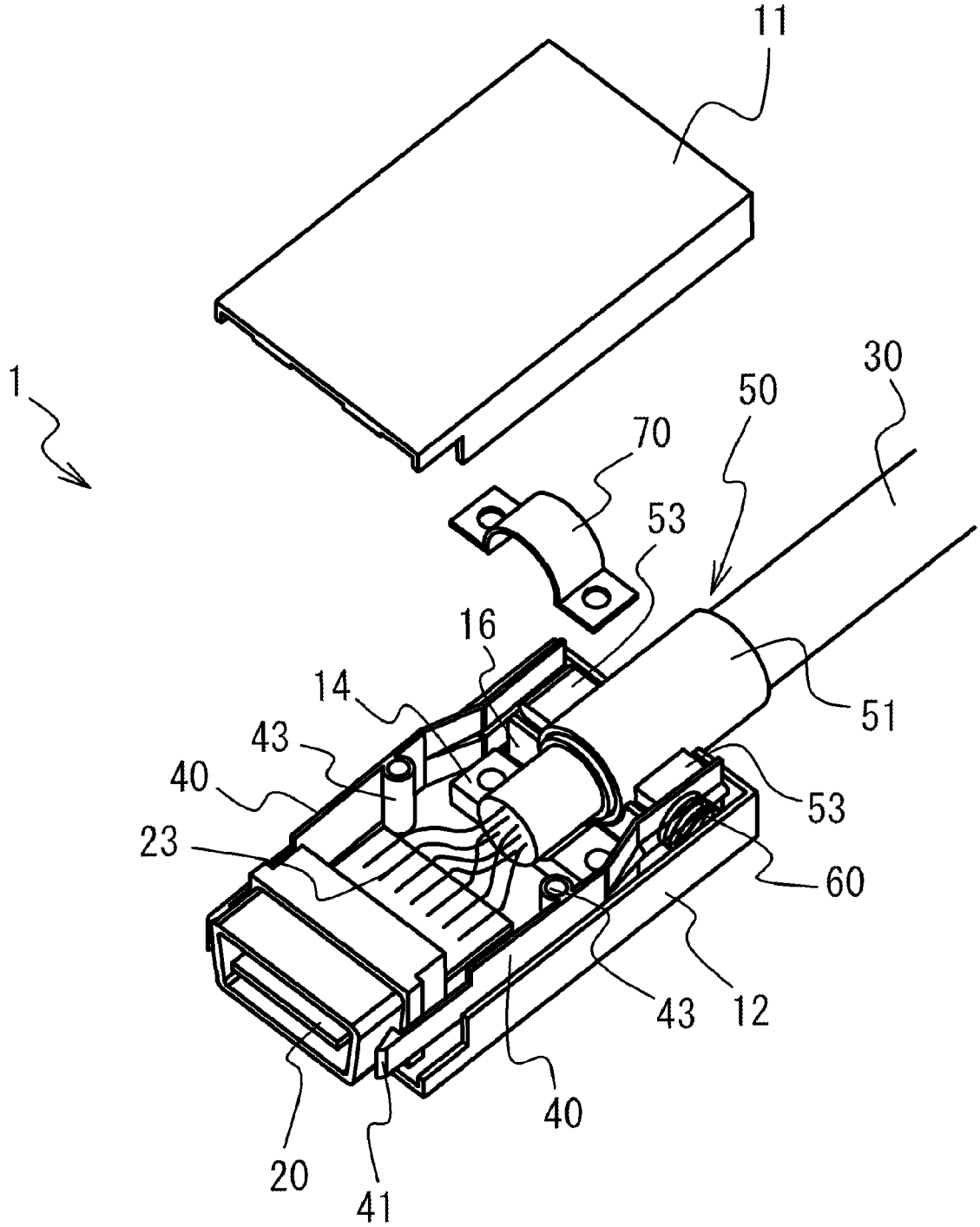
FIG. 6 is a perspective view of an inner structure of the connector according to the first embodiment.
Figure 7A:
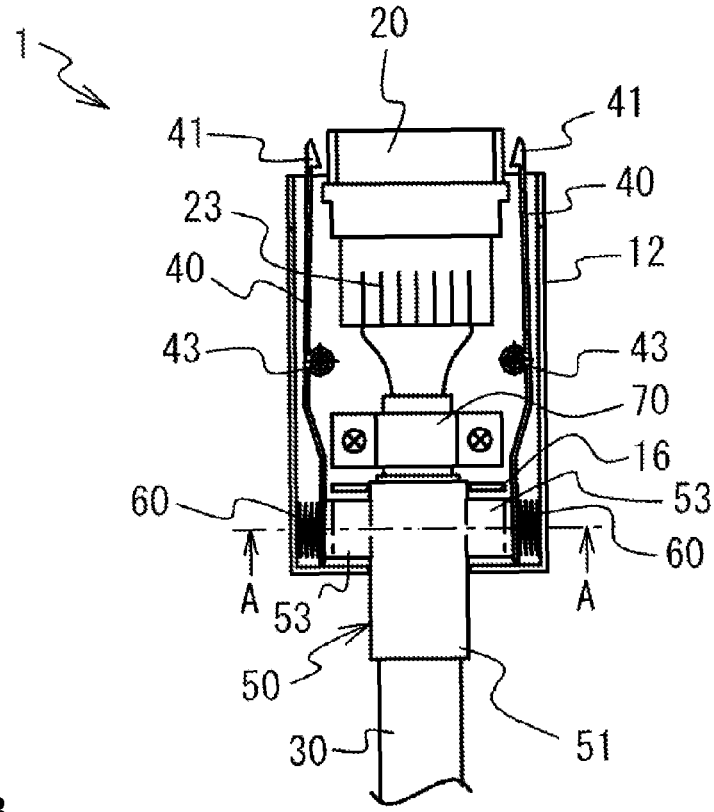
FIGS. 7A and 7B are front views of the inner structure of the connector according to the first embodiment.
Figure 7B:
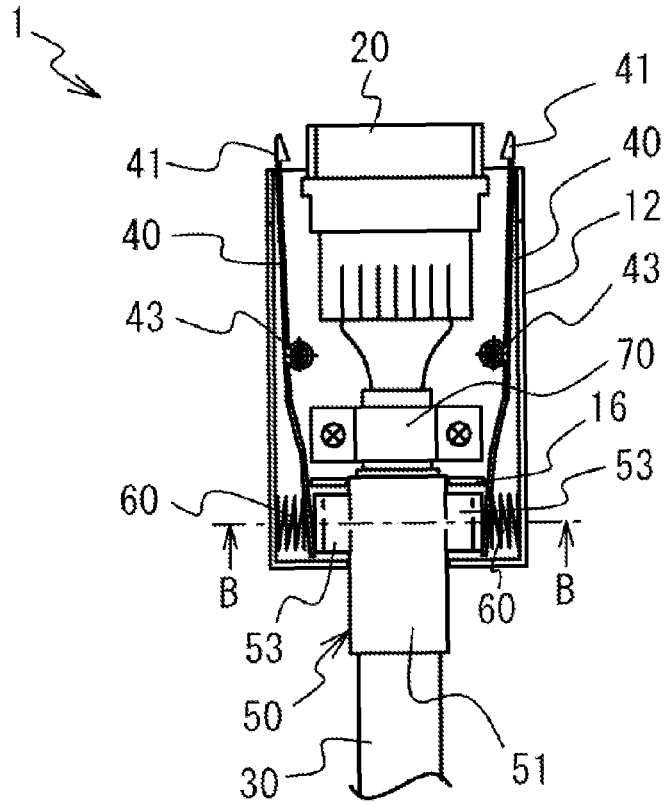

Next, a description will be given of an inner structure of the connector 1 in more detail. FIG. 6 is a perspective view of the inner structure of the connector 1. FIGS. 7A and 7B are front views of the inner structure of the connector 1. FIG. 7A illustrates the inner structure of the connector 1 in the locked state. FIG. 7B illustrates the inner structure of the connector 1 in the release state. The housing 10 includes cases 11 and 12. FIGS. 6, 7A and 7B illustrate the state in which the case 11 is removed from the case 12.

As illustrated in FIGS. 6, 7A and 7B, the contact 20 and the cable 30 is connected to each other via a relay board 23. Additionally, the case 12 is provided with a support stage 14 for supporting the cable 30. The support stage 14 is attached to a cable clamp 70. This attaches the cable 30 to the housing 10. Further, the case 12 is provided with a support plate 16 which supports the operating portion 50 for rotation relative to the housing 10. Similarly, the case 11 is provided with a support plate, not illustrated. The support plate 16 has a thin plate shape. The support plate 16 is formed with a semi-arc shaped cutout which is in sliding contact with the operating portion 50.

The engagement piece 40 has a cylindrical portion 43 at a substantially center position in the longitude direction of the engagement piece 40. Further, the cylindrical portion 43 is arranged at an inner side of the engagement piece 40. The cylindrical portion 43 is rotatably supported by spindles, not illustrated, each provided in the cases 11 and 12. In this manner, the engagement piece 40 is movably supported between the locked position, in which the engagement piece 40 engages with the opponent engagement piece 140, and the released position, in which the engagement is released.

Further, a coil spring (lock mechanism) 60 is arranged between a rear end of the engagement piece 40 and an inner side, of the case 12, facing the engagement piece 40. The coil spring 60 is included in the lock mechanism. The coil spring 60 urges the rear end of the engagement piece 40 toward the operating portion 50. As will be discussed later in detail, the coil spring 60 urges the engagement piece 40 toward the released position.

The operating portion 50 includes a cylindrical portion (tube shaped portion) 51 penetrating through the housing 10, and two arm portions 53 projecting radially outwardly from the cylindrical portion 51 within the housing 10. The two arm portions 53 have a liner shape so as to intersect with the central axis of the operating portion 50. The two engagement pieces 40 are arranged to sandwich the cylindrical portion 51. The two arm portions 53 correspond to the two engagement pieces 40, respectively.

Figure 8A:
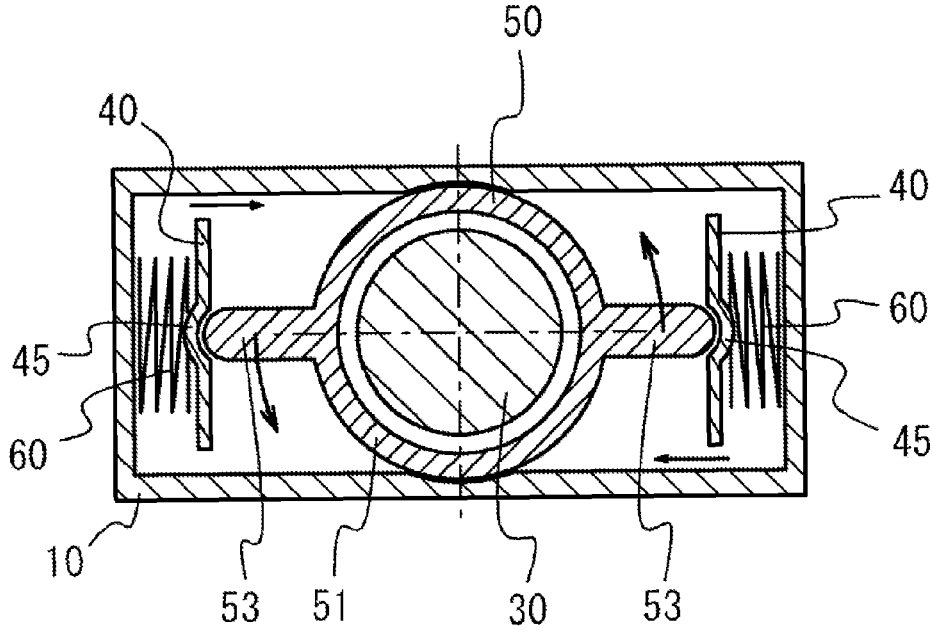
FIGS. 8A and 8B are cross-sectional views of the connector according to the first embodiment.
Figure 8B:
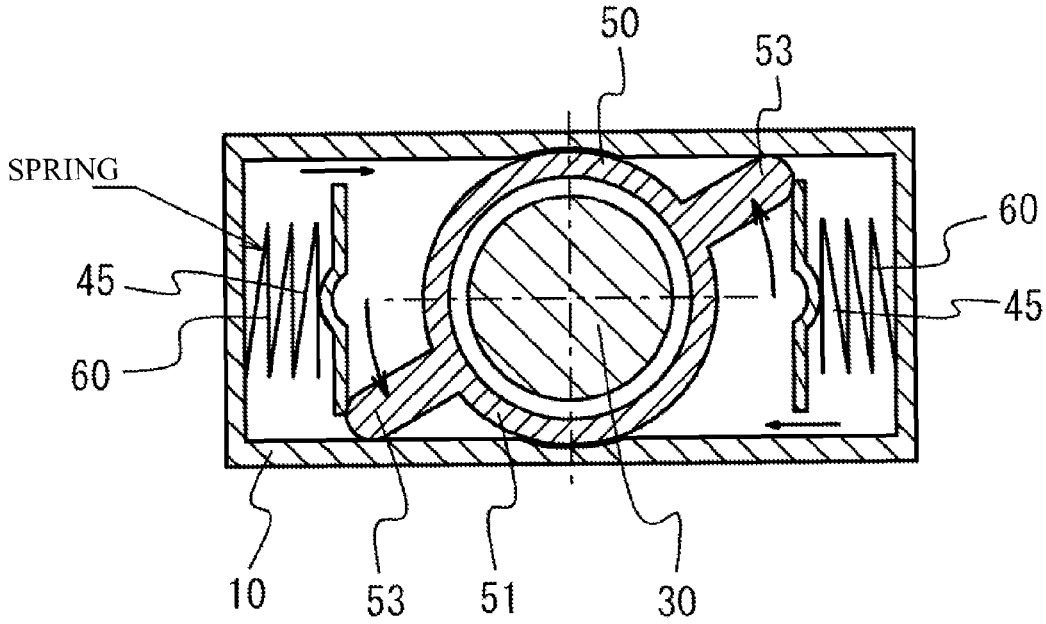

FIGS. 8A and 8B are cross-sectional views of the connector 1. FIG. 8A is a cross-sectional view taken along A-A in FIG. 7A. FIG. 8B is a cross-sectional view taken along B-B in FIG. 7B. As illustrated in FIGS. 7A and 8A, the engagement piece 40 is regulated to the locked position in which the engagement piece 40 is capable of engaging with the opponent engagement piece 140. In particular, the arm portion 53 of the operating portion 50 urges the rear end of the engagement piece 40 toward the side wall of the housing 10 against the biasing force of the coil spring 60. Therefore, regarding the engagement piece 40, the two hook portions 41 are positioned to come closer to each other with respect to the cylindrical portion 43 serving as a pivot point.

In this state, when the operating portion 50 is operated, the arm portion 53 swings to be receded from the rear end of the engagement piece 40 as illustrated in FIG. 8B. This allows the rear end of the engagement piece 40 to move toward the inside in response to the biasing force of the coil spring 60. Therefore, the two hook portions 41 move away form each other with respect to the cylindrical portion 43 serving as a pivot point. That is, the two hook portions 41 move to open outwardly from the connector 1. The engagement of the hook portion 41 with the hook portion 141 is thus released. In this manner, the engagement piece 40 is positioned to the released position.

As mentioned above, the operating portion 50 switches between the state in which the operating portion 50 pushes and regulates the engagement piece 40 to the locked position and the state in which the operating portion 50 is receded from the engagement piece 40 to allow the engagement piece 40 to move to the released position. Thus, the lock is released.

Further, the engagement piece 40 is provided with a concave portion 45 as illustrated in FIGS. 8A and 8B. The concave portion 45 is engagable with the arm portion 53 regulating the engagement piece 40 to the locked position. In particular, the concave portion 45 is formed at a substantially center in a widthwise direction of the engagement piece 40. The concave portion 45 extends toward the inner side wall, of the housing 10, facing the engagement piece 40. As illustrated in FIG. 8A, the concave portion 45 and an end of the arm portion 53 are engaged with each other, when the engagement piece 40 is positioned to the locked position. This maintains the locked state. Consequently, when the connection of the connector 1 with the opponent connector 101 is being locked, the lock can be prevented from being released by the operating portion 50 by chance due to an impact or the like. Additionally, the concave portions 45 each is provided in each of the two engagement pieces 40, thereby maintaining the locked state in a more stable manner. When the operating portion 50 is rotated, the end of the arm portion 53 is disengaged from the concave portion 45, so that the lock is released as illustrated in FIG. 8B.

Second Embodiment

Figure 9:
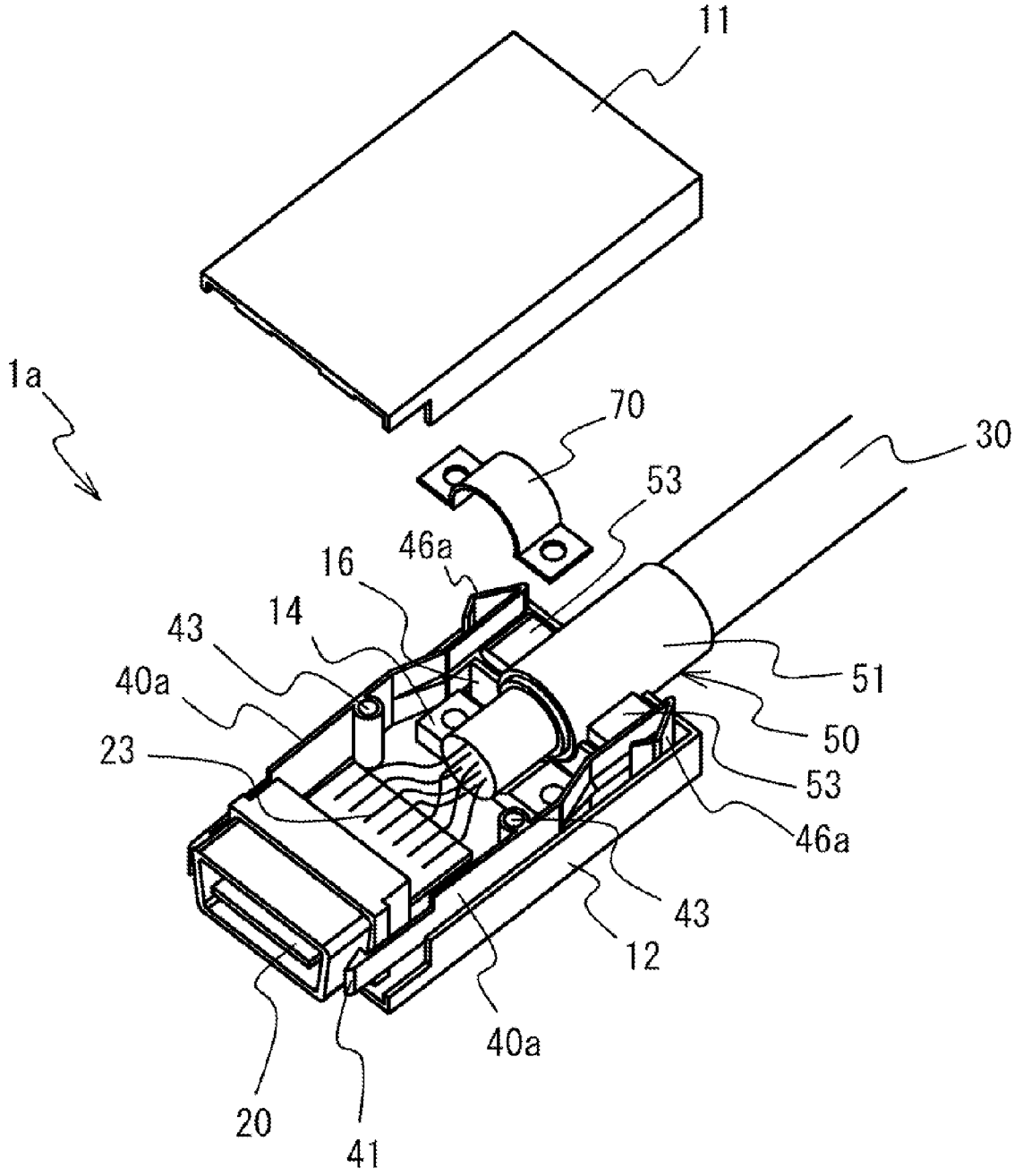
FIG. 9 is a perspective view of an inner structure of a connector according to a second embodiment.
Figure 10:
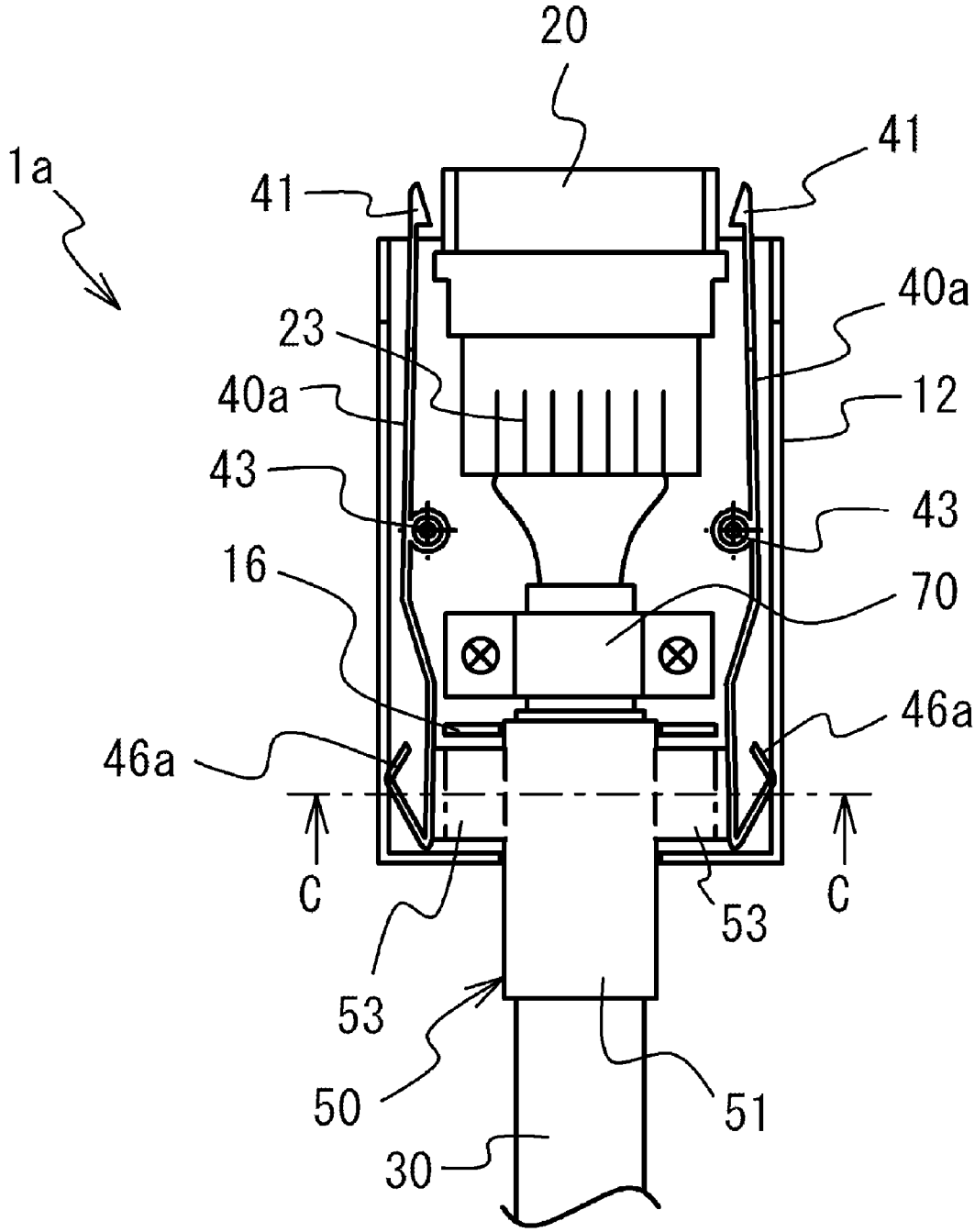
FIG. 10 is a front view of the inner structure of the connector according to the second embodiment.
Figure 11:
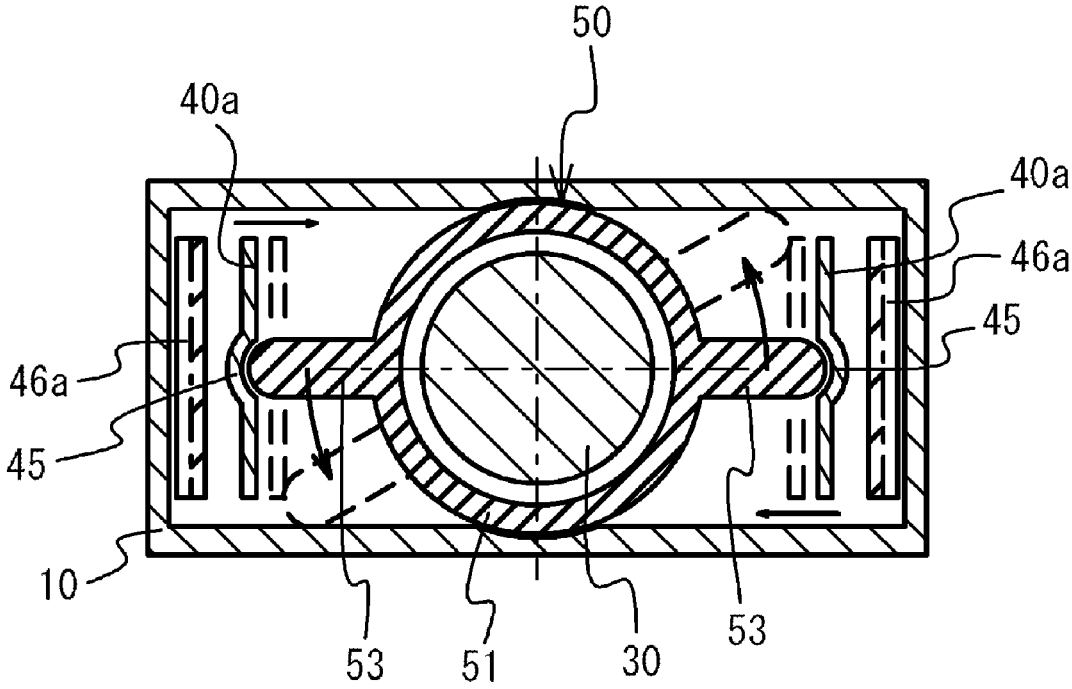
FIG. 11 is a cross-section taken along C-C in FIG. 10.

Next, a description will be given of a connector 1*a* according to a second embodiment. Similar reference numerals are used to denote similar component of the connector 1 according to the first embodiment, and a detail description is omitted. FIG. 9 is a perspective view of the inner structure of the connector 1*a* according to the second embodiment. FIG. 10 is a front view of the inner structure of the connector 1*a*. FIG. 11 is a cross-section taken along C-C in FIG. 10.

As illustrated in FIG. 9, a plate spring portion (biasing portion) 46*a* is provided at the rear end of an engagement piece 40*a*. The plate spring portion 46*a* is bent. The plate spring portion 46*a* is accommodated with being compressed between a side wall of the case 12 and the arm portion 53 of the operating portion 50. Therefore, the elastic repulsive force is effected toward the operating portion 50. The rear end of the engagement piece 40*a* thus moves toward the operating portion 50 with respect to the cylindrical portion 43 serving as a pivot.

As with the connector 1 according to the first embodiment, the rotational operation of the operating portion 50 from the state as illustrated in FIG. 11 causes the arm portion 53 to be receded from the engagement piece 40*a*. Then, the rear end of the engagement piece 40*a* moves toward the arm portion 53 receded by the repulsive force of the plate spring portion 46*a*. With this reason, the two hook portions 41 are moved away from each other, so that the lock is released. In FIG. 11, the engagement piece 40*a* and the operating portion 50, positioned in the released position, are illustrated by a broken line.

As described, unlike the connector 1 according to the first embodiment, the lock can be released without the provision of the spring. As mentioned above, in the connector 1 a according to the second embodiment, the number of the parts can be reduced, thereby further reducing the manufacturing cost.

Third Embodiment

Figure 12:
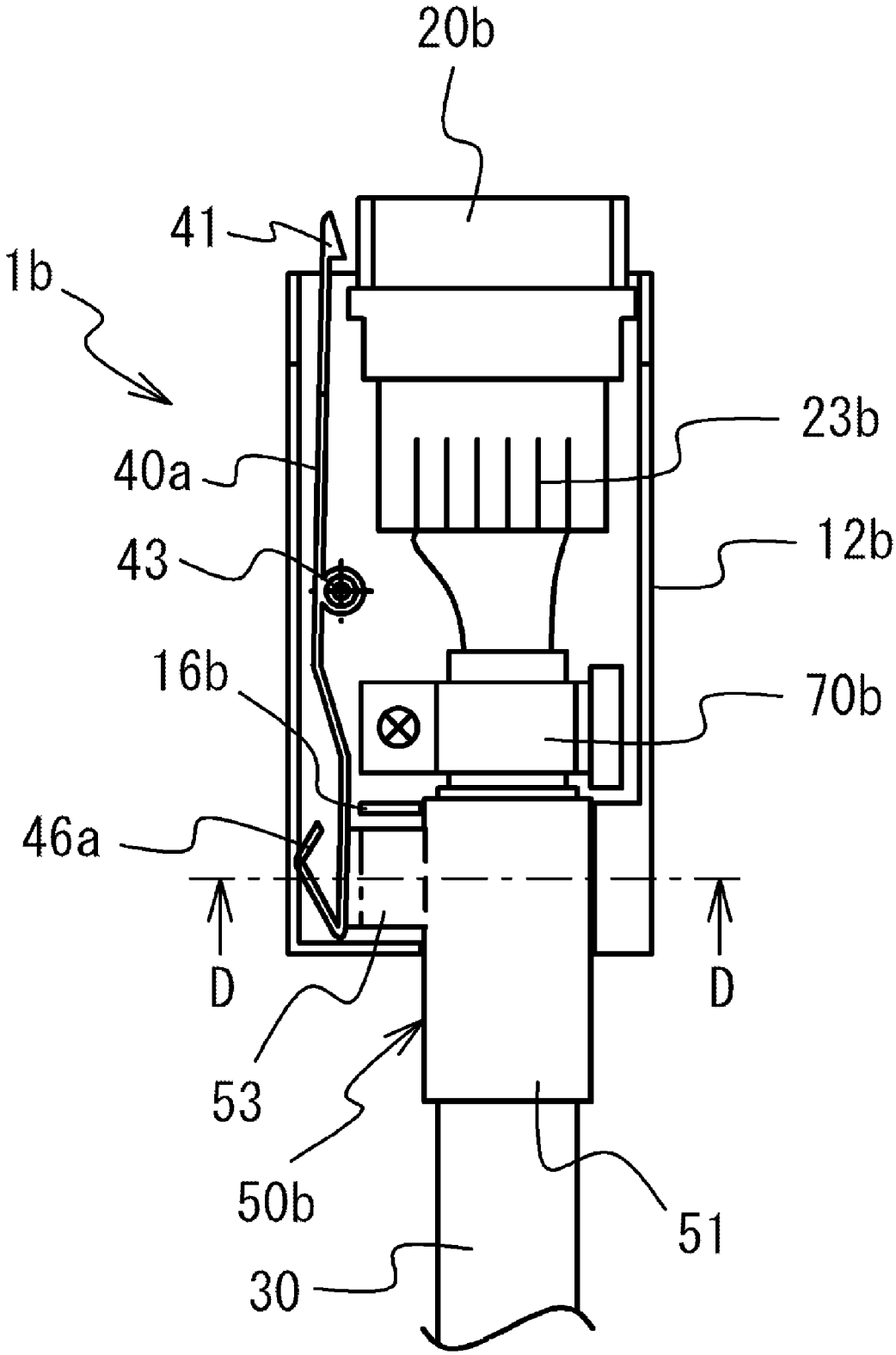
FIG. 12 is a front view of an inner structure of a connector according to the third embodiment.
Figure 13:
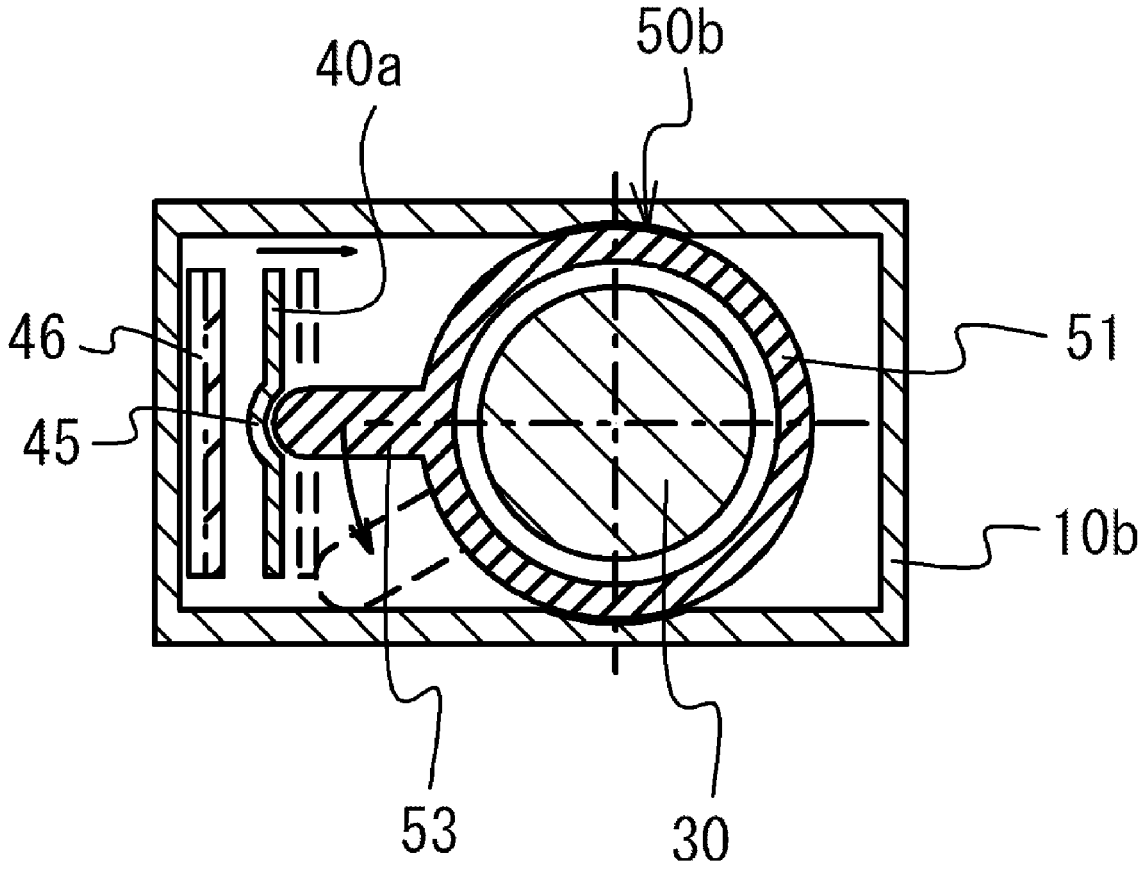
FIG. 13 is a cross-sectional view taken along D-D in FIG. 12.

Next, a description will be given of a connector 1*b* according to a third embodiment. FIG. 12 is a front view of an inner structure of the connector 1*b* according to the third embodiment. FIG. 13 is a cross-sectional view taken along D-D in FIG. 12. As illustrated in FIG. 12, the connector 1*b* is provided with a single engagement piece 40*a*. The engagement piece 40*a* is arranged along one of inner side walls of the case 12*b*.

Further, the case 12*b* is downsized in the widthwise direction more than the connectors 1, 1*a*, according to the embodiments mentioned above. Corresponding to this downsizing, a relay board 23*b* and a cable clamp 70*b*, both of which are downsized in the width direction is employed.

An operating portion 50*b* is provided with a single arm portion 53. Since only one engagement piece 40*a* is employed, only one arm portion 53 which regulates the engagement piece 40*a* is enough. The arm portion 53 is receded from the engagement piece 40*a* in response to the rotational operation of the operating portion 50*b*, and the rear end of the engagement piece 40*a* moves inwardly by the effect of the plate spring portion 46. The engagement piece 40*a* moves to the released position. This point is same as the connectors 1, 1*a* according to the embodiments mentioned above.

As described above, the downsizing of the connector 1*b* in the widthwise direction can be achieved. Additionally, the connection can be locked by only a single engagement piece 40*a*, so that the number of the parts is reduced, thereby further reducing the manufacturing cost of the connector 1*b*. Furthermore, only a small number of the movable parts for locking the connection is provided, so that its endurance is improved.

Fourth Embodiment

Figure 14:
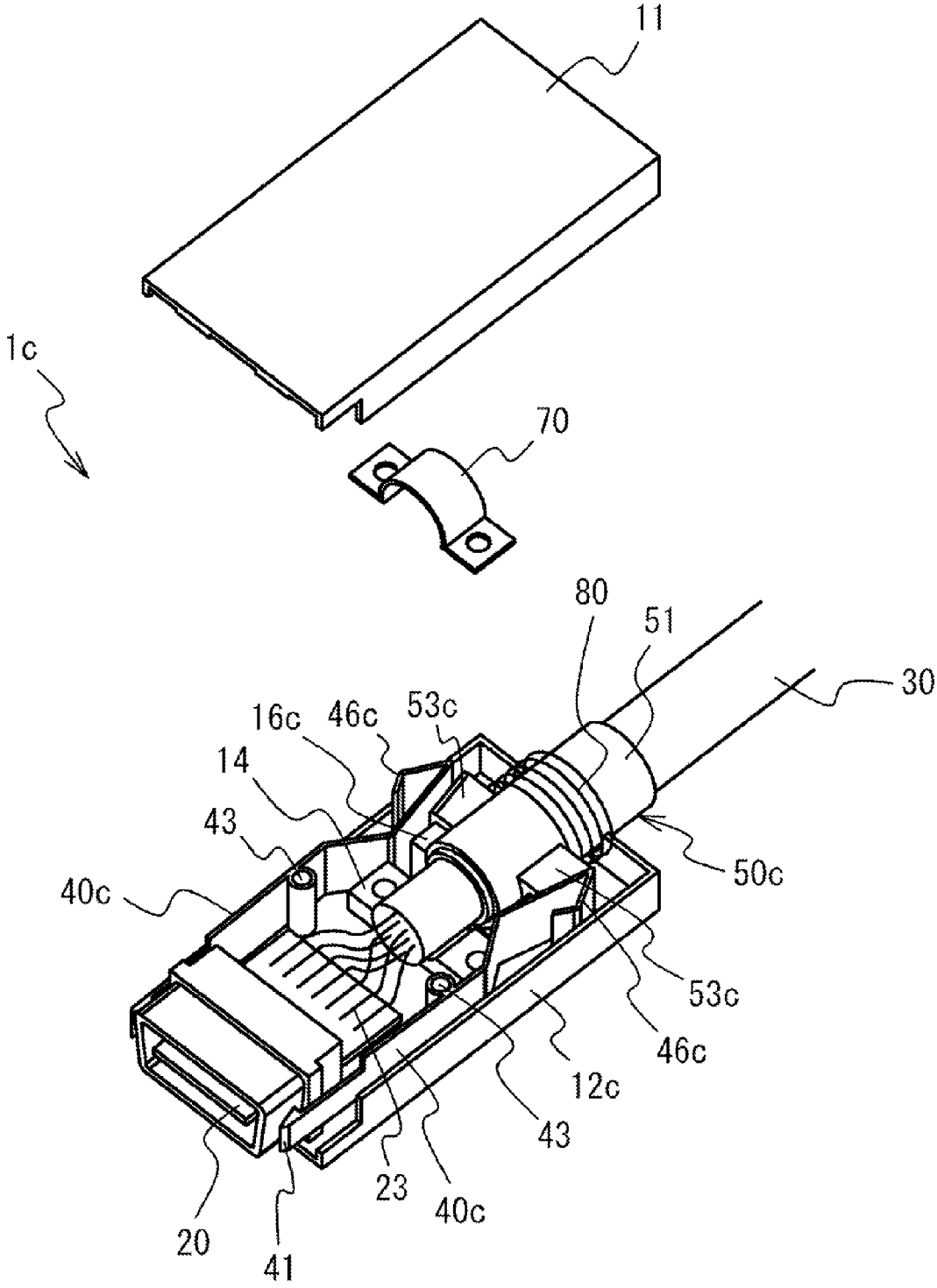
FIG. 14 is a perspective view of an inner structure of a connector according to a fourth embodiment.
Figure 15A:
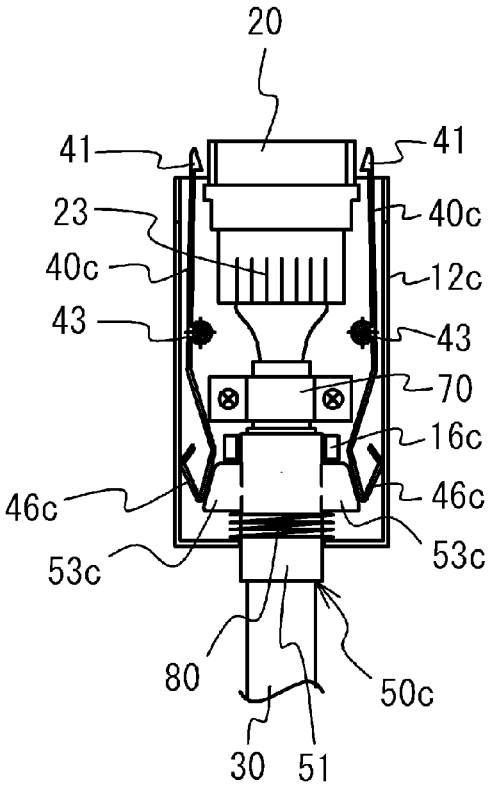
FIGS. 15A and 15B are front views of the inner structure of the connector according to the fourth embodiment.
Figure 15B:
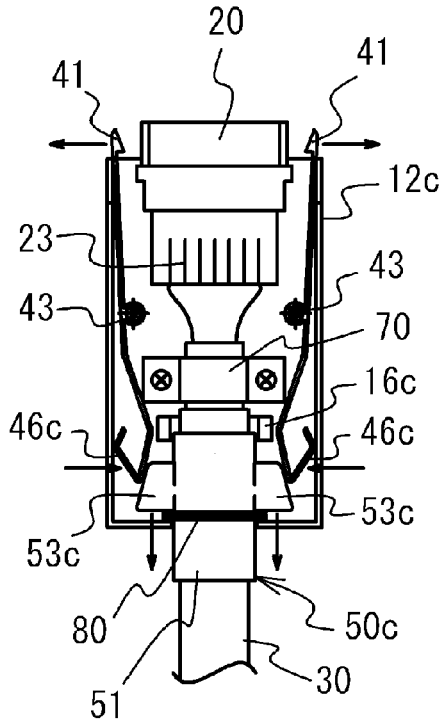

Next, a description will be given of a connector 1*c* according to a fourth embodiment. FIG. 14 is a perspective view of an inner structure of the connector 1*c* according to the fourth embodiment. FIGS. 15A and 15B are front views of the inner structure of the connector 1*c*. FIG. 15A illustrates the locked state, and FIG. 15B illustrates the released state. The connector 1*c* can be released by pulling operation of the operating portion 50*c*.

As illustrated in FIGS. 14, 15A and 15B, in two arm portions 53*c* provided in the operating portion 50*c*, surfaces contactable with the rear end of an engagement piece 40*c* are inclined. Specifically, the one ends of the arm portions 53*c* are made wider toward the cable 30 from the contact 20, as seen from the front of the operating portion 50*c*.

A coil spring (lock mechanism, maintaining portion) 80 is provided in the connector 1*c* and urges the operating portion 50*c* toward the contact 20. The coil spring 80 is arranged concentrically around the cylindrical portion 51. Further, the coil spring 80 is arranged between the arm portion 53*c* and the inner wall at the rear end side of the housing 10. The case 12 is provided with a support plate 16*c* supporting the operating portion 50*c*. Likewise, the case 11 is provided with a supporting plate, not illustrated.

In a normal state, the operating portion 50*c* is urged toward the contact 20 by the biasing force of the coil spring 80, so that the arm portion 53*c* is maintained to be in contact with the support plate 16*c*. Therefore, the support plate 16*c* has a function of regulating the position of the arm portion 53*c*. This positions the engagement piece 40*c* to be positioned to the locked position. Namely, the coil spring 80 maintains the state of the operating portion 50*c* such that the engagement piece 40*c* is regulated to the locked position. Further, the support plate 16*c* is made thicker than the support plate 16 of the connector 1 according to the first embodiment. This is because the arm portion 53*c* is urged to the support plate 16*c* by the coil spring 80.

When the operating portion 50*c* is pulled to the cable 30 side against the biasing force of the coil spring 80 from the state as illustrated in FIG. 15A, the operating portion 50*c* moves away from the support plate 16*c*. Next, the arm portion 53*c* is receded to the cable 30 side from the rear end of the engagement piece 40*c*. In this case, by the effect of the elastic repulsive force of the plate spring portion 46*c*, the rear end of the engagement piece 40*c* moves inwardly with respect to the cylindrical portion 43 serving as a pivot point, and the hook portion 41 moves outwardly, as illustrated in FIG. 15B. In this manner, the engagement piece 40*c* moves to the released position. Additionally, the arm portion 53*c* moves in contact with the rear end of the engagement piece 40*c* during the pulling operation of the operating portion 50*c*.

The connector 1*c* can release the lock in response to the pulling operation in this way. Further, since the lock is released with the operating portion 50*c* pulled, the connector 1*c* can be continually pulled out of the opponent device 100. In this manner, the series of the operations allow the lock to be released and allows the connector 1*c* to be removed.

Additionally, the operating portion 50*c* again comes into contact with the support plate 16*c* with the biasing force of the coil spring 80, after the pulling operation of the operating portion 50*c*. Thus, the engagement piece 40*c* returns to the locked position.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A connector comprising:

a contact;

a housing holding the contact;

a cable inserted into the housing;

a lock mechanism held in the housing and lockable with an opponent connector; and an operating portion including a tube shape portion covering the cable, operably connected to the housing, releasing the lock in response to an operation, and the tube shape portion penetrating through the housing, a diameter of the tube shape portion being smaller than a width of the housing.

2. The connector of claim 1 wherein a diameter of the tube shape portion is smaller than a height of the housing.

3. The connector of claim 1 wherein the operating portion releases the lock in response to a rotating operation.

4. The connector of claim 1 wherein the operating portion releases the lock in response to a pulling operation.

5. The connector of claim 1 wherein:

the lock mechanism includes an engagement piece movable between a locked position and a released position, the locked position in which the engagement piece engages with an opponent engagement piece of the opponent connector, the released position in which the engagement piece releases the opponent engagement piece;

the operating portion further includes an arm portion projecting outwardly from the tube shape portion; and the arm portion switches a state in which the arm portion pushes the engagement portion to regulate the engagement portion to the locked position from a state in which the arm portion is receded from the engagement portion to allow the engagement portion to move to the released position in response to an operation of the operating portion.

6. The connector of claim 5 wherein:

the lock mechanism includes a biasing portion urging the engagement piece to the released position; and the arm portion changes the state in which the arm portion regulates the engagement portion to the locked position against an biasing force of the biasing portion to the state in which the arm portion allows the engagement piece to move to the released position in response to the biasing force in response to the operation of the operating portion.

7. The connector of claim 5 wherein:

the engagement portion includes an biasing portion urging the engagement portion toward the released position; and the arm portion switches from the state in which the arm portion regulates the engagement piece to the locked position against a biasing force of the biasing portion to the state in which the arm portion allows the engagement piece to move toward the released position in accordance with the biasing force in response to the operation of the operating portion.

8. The connector of claim 5 wherein the engagement piece includes a plurality of the engagement pieces sandwiching the tube shape portion, and the arm portion includes a plurality of the arm portions respectively corresponding to the plurality of the engagement pieces.

9. The connector of claim 5 wherein the arm portion is receded from the engagement piece in response to a rotating operation of the operating portion.

10. The connector of claim 9 wherein the engagement portion includes a concave portion engagable with the arm portion regulating the engagement piece to the locked position.

11. The connector of claim 5 wherein the arm portion is receded from the engagement piece in response to a pulling operation of the operating portion.

12. The connector of claim 11 wherein the lock mechanism includes a maintaining portion maintaining a state of the operating portion such that the engagement piece is regulated to the locked position.

13. An electronic device system comprising:

a first connector provided in a main electronic system, the first connector comprising:

a first contact; and a first lock mechanism; and a second connector connectable with the first connector, the second connector comprising:

a second contact connectable with the first contact;

a housing holding the second contact;

a cable inserted into the housing;

a second lock mechanism held in the housing and lockable with the first lock mechanism; and an operating portion including a tube shape portion covering the cable, operably connected to the housing, releasing the lock of the second lock mechanism in response to an operation, and the tube shape portion penetrating through the housing, a diameter of the tube shape portion being smaller than a width of the housing.

14. A connector comprising:

a contact;

a housing holding the contact;

a cable inserted into the housing;

a lock mechanism held in the housing and lockable with an opponent connector; and an operating portion including a tube shape portion covering the cable, operably connected to the housing, and releasing the lock in response to an operation, wherein the operating portion releases the lock in response to a pulling operation, wherein the lock mechanism includes an engagement piece movable between a locked position and a released position, the locked position in which the engagement piece engages with an opponent engagement piece of the opponent connector, the released position in which the engagement piece releases the opponent engagement piece;

the operating portion further includes an arm portion projecting outwardly from the tube shape portion; and the arm portion switches a state in which the arm portion pushes the engagement portion to regulate the engagement portion to the locked position from a state in which the arm portion is receded from the engagement portion to allow the engagement portion to move to the released position in response to an operation of the operating portion.

* * * * *